US012604995B2

(12) United States Patent
Bennett

(10) Patent No.: US 12,604,995 B2
(45) Date of Patent: Apr. 21, 2026

(54) SMART BED WITH MATTRESS THAT RESPONDS TO PHYSICAL INPUTS

(71) Applicant: Purple Innovation, LLC, Lehi, UT (US)

(72) Inventor: Thomas Andrew Bennett, Irvine, CA (US)

(73) Assignee: Purple Innovation, LLC, Lehi, UT (US)

( * ) Notice: Subject to any disclaimer, the term of this patent is extended or adjusted under 35 U.S.C. 154(b) by 255 days.

(21) Appl. No.: 18/104,699

(22) Filed: Feb. 1, 2023

(65) Prior Publication Data

US 2024/0251965 A1 Aug. 1, 2024

(51) Int. Cl.
*A47C 31/12* (2006.01)
*A47C 21/00* (2006.01)

(52) U.S. Cl.
CPC ..... *A47C 31/123* (2013.01); *A47C 21/003* (2013.01)

(58) Field of Classification Search
CPC ..... A47C 17/00; A47C 19/00; A47C 19/04; A47C 19/12; A47C 19/22; A47C 20/04; A47C 20/041; A47C 21/003; A47C 31/008; A47C 31/123
See application file for complete search history.

(56) References Cited

U.S. PATENT DOCUMENTS 8,458,042 B1 * 6/2013 Roberts ..... G06Q 30/02 705/26.1
8,919,750 B2 * 12/2014 Pearce ..... A47C 7/02 267/153
9,005,101 B1 * 4/2015 Van Erlach ..... A47C 31/123 600/9
9,635,953 B2 * 5/2017 Nunn ..... A47C 27/10
11,793,455 B1 * 10/2023 Kahn ..... A47C 20/04
2010/0191136 A1 * 7/2010 Wolford ..... A61B 5/00 600/534
2013/0289770 A1 * 10/2013 Rawls-Meehan .... A47C 20/041 700/275
2015/0320354 A1 * 11/2015 Oakhill ..... A61B 5/7475 600/595
2017/0112716 A1 * 4/2017 Rawls-Meehan ..... A61H 23/0263

(Continued)

OTHER PUBLICATIONS

United States Patent and Trademark Office, acting as International Searching Authority, "International Search Report and Written Opinion," International Application No. PCT/US2024/012784, May 6, 2024.

*Primary Examiner* — George Sun
(74) *Attorney, Agent, or Firm* — Foley & Lardner LLP

(57) ABSTRACT

A smart bed with a mattress that detects the one or more physical inputs, identifies at least one function corresponding to each physical input, and responds to each physical input by executing the at least one function. The physical input may be provided as a tap, pat, slap, stomp, or kick on a surface of the mattress. One or more sensors of the mattress may detect each physical input. A processor of the smart bed may identify and execute the at least one function associated with the at least one physical input. In addition, the processor may identify an individual who provided the physical input(s) and execute the corresponding function(s) in a manner tailored to the individual who provided the physical input(s). Methods of using such a smart bed are also disclosed.

20 Claims, 6 Drawing Sheets

(56) References Cited

U.S. PATENT DOCUMENTS

| | | | | |
|---|---|---|---|---|
| 2018/0116415 | A1* | 5/2018 | Karschnik | A47C 27/15 |
| 2018/0125256 | A1* | 5/2018 | Tsern | A47C 27/083 |
| 2018/0213944 | A1* | 8/2018 | Bedel | A47C 21/044 |
| 2018/0289175 | A1* | 10/2018 | Lukas | A47C 31/008 |
| 2019/0279745 | A1* | 9/2019 | Sayadi | A47C 27/083 |
| 2019/0320808 | A1* | 10/2019 | Chapin | A47C 21/044 |
| 2019/0336721 | A1* | 11/2019 | Tsern | A47C 23/002 |
| 2020/0178887 | A1* | 6/2020 | Correa Ramírez | A61B 5/4809 |
| 2021/0034989 | A1* | 2/2021 | Palashewski | A61B 5/002 |
| 2021/0295661 | A1* | 9/2021 | Tadele | A61B 5/6892 |
| 2021/0307534 | A1* | 10/2021 | Krenik | A47C 27/14 |
| 2022/0211188 | A1* | 7/2022 | Daub | A47B 13/00 |
| 2022/0273115 | A1* | 9/2022 | Karschnik | A47C 21/003 |
| 2022/0287474 | A1* | 9/2022 | Wang | A47C 20/04 |
| 2022/0330892 | A1* | 10/2022 | Lee | A61B 5/4094 |
| 2022/0354431 | A1* | 11/2022 | Garcia Molina | A61B 5/02055 |
| 2023/0148762 | A1* | 5/2023 | Karschnik | A47C 21/003 5/713 |
| 2023/0189982 | A1* | 6/2023 | Rubio | A47C 17/38 5/11 |
| 2023/0190199 | A1* | 6/2023 | Garcia Molina | A61B 5/4806 600/485 |
| 2023/0210269 | A1* | 7/2023 | Hill | A47C 31/008 362/130 |

* cited by examiner

SMART BED WITH MATTRESS THAT RESPONDS TO PHYSICAL INPUTS

TECHNICAL FIELD

This disclosure relates generally to smart beds and, more specifically, to smart beds with mattresses that respond to physical inputs, such as touch inputs (e.g., a tap, a pat, a slap, etc.). More specifically, this disclosure relates to smart beds that adjust in response to detecting a predetermined physical input on a mattress of the smart bed. This disclosure also relates to methods for providing physical inputs for smart beds and methods for adjusting smart beds, which may include providing a predetermined physical input on a mattress of the smart bed, detecting the physical input, and responding to the physical input.

SUMMARY

In various aspects, smart beds with configurations that enable the smart beds or the mattresses thereof to receive, detect, and respond to physical inputs are disclosed.

A smart bed may include a mattress with an upper surface that defines a sleep surface, at least one sensor associated with the sleep surface, and a processor that communicates with the at least one sensor and controls one or more functions of the mattress. A smart bed may also include a foundation for the mattress. In some embodiments, the smart bed may interact with an environment in which the mattress is located.

The mattress may have any suitable configuration. As a few examples, the mattress may comprise a conventional mattress with coils, a so-called "memory foam" mattress, a mattress with one or more bladders that may be selectively pressurized, a gel mattress, or a mattress that includes a combination of these and/or other features.

The at least one sensor may be capable of detecting motion or another activity (e.g., proximity, the application of pressure, etc.) to a surrounding area of the sleep surface of the mattress. Each sensor may comprise an accelerometer. More specifically, the at least one sensor may be positioned adjacent to the sleep surface at a location where it may detect a physical input provided by an individual, such as an individual adjacent to the mattress or an individual on the sleep surface. In some embodiments, the at least one sensor may be positioned at a location where an individual would be expected to rest their body, or torso, and/or their legs when laying in a sleeping position on the sleep surface. In other embodiments, the at least one sensor may comprise a group of sensors, such as any combination of a sensor at the side of the mattress (e.g., a sensor positioned over a rail of the mattress, on a side of a rail of the mattress, within a rail of the mattress, etc.), a sensor at a location where an individual would be expected to rest their body when assuming a sleeping position on the sleep surface, a sensor at a location where the individual would be expected to rest their legs when assuming a sleeping position on the sleep surface, and a sensor at any other location that may enable it receive an input.

One or more sensors of a mattress of a smart bed of this disclosure may receive, detect, and respond to physical inputs. The physical inputs may be provided on a mattress of the smart bed. In some embodiments, the physical inputs may be provided at or near one or more specific locations on a surface of the mattress. Without limitation, a physical input may be provided at a location on a surface of the mattress that an individual could readily reach with their hand as they lie on the mattress. Some non-limiting examples of such locations include a somewhat central location along the length of an edge of the mattress (e.g., near where an individual would be able to reach the side of the mattress while the individual lies on the mattress, etc.), at a somewhat central location along the length of an upper surface, or a sleep surface, of the mattress, and at a location on the upper surface of the mattress adjacent to where an individual would typically place their head (e.g., near a head edge of the mattress, etc.). A physical input may be provided at a location that an individual could readily access with their feet, such as a foot end of the sleep surface.

In some embodiments, the physical inputs may be provided as taps on the surface of the mattress, slaps on the surface of the mattress, or the like. Physical inputs may be distinguished from each other by type or intensity (e.g., a tap, a pat, a slap, etc.), number of physical inputs in a sequence of physical inputs (e.g., one, two, three, etc.), pattern (e.g., the amount of time that passes between physical inputs in a sequence of physical inputs, etc.), or the like, or any combination of the foregoing. A physical input may be predefined to correspond to a particular function and, thus, be universal from mattress-to-mattress. Alternatively, a physical input may be user-defined to correspond to a particular function.

The processor, which communicates with (e.g., receives signals from, etc.) each sensor associated with the sleep surface of the mattress, may comprise one or more processing elements of a suitable type. In some embodiments, the processor may comprise one or more microcontrollers, which may execute an embedded program (e.g., firmware) to control one or more dedicated functions. The processor may be carried by the mattress (e.g., internally, adjacent to a foot of the mattress; etc.).

Based on data generated by the at least one sensor, the processor may be programmed to determine when an individual has provided physical input on the mattress, or detect a physical input provided by an individual on a surface of the mattress. Based on data generated by the at least one sensor, the processor may also be programmed to interpret a physical input and correlate the physical input to a particular action to be taken by the mattress or a smart bed of which the mattress is a part. The processor may then initiate at least one function (e.g., an adjustment of the mattress, an adjustment of another component of the smart bed, an adjustment to an environment in which the smart bed is located, etc.) that corresponds to each physical input provided on the mattress.

In some embodiments, the processor may distinguish physical inputs provided by one individual from physical inputs provided by another individual. Thus, in such embodiments, the processor may identify the individual who provided the physical input and initiate the corresponding function(s) in a manner tailored to the individual who provided the physical input.

A few nonlimiting examples of functions that may be activated by a physical input may include adjusting an orientation of the mattress or a portion thereof (e.g., a side of a queen size or king size mattress where the physical input was provided, etc.), adjusting a firmness (or softness) of the mattress or a portion thereof (e.g., pressurization of a bladder within the mattress, etc.), ventilating the mattress or a portion thereof, adjusting a temperature of the mattress or a portion thereof, actuating an anti-snore feature of the smart bed (e.g., its foundation, its mattress, etc.) or a portion thereof (e.g., on the other side of the smart bed, etc.), dimming of lights or turning off lights in a room where the smart bed is located (e.g., a bedroom) and, optionally, elsewhere in the living space (i.e., outside the room where the smart bed is located), etc.

In addition to the mattress, the at least one sensor, and the processor, a smart bed of this disclosure may include a transceiver, along with an associated antenna. The transceiver may be associated with the processor in a manner that enables the processor to communicate with a processor of a portable electronic device (e.g., a smart phone, a tablet computer, a smart watch, etc., that executes a smart bed control app, etc.).

In embodiments where the smart bed includes a foundation, the foundation may comprise an adjustable platform. The adjustable platform may include a plurality of support surfaces, at least one motor, and a processor. The plurality of support surfaces can carry the mattress of the smart bed. The at least one motor, under control of the processor, may move the plurality of support surfaces to desired orientations, which may move a mattress carried by the plurality of support surfaces to a desired arrangement. In addition, the adjustable platform may include a transceiver, along with an associated antenna. The transceiver may establish communication with the processor of the remainder of the smart bed (e.g., the processor of the mattress, etc.) and/or with a processor of a portable electronic device, which may execute the smart bed control app.

In a method of this disclosure, a smart bed receives, detects, and responds to one or more physical inputs. A physical input may be predefined to correspond to a particular function and, thus, be universal from mattress-to-mattress. Alternatively, a user may define one or more physical inputs for one or more corresponding functions.

An individual may provide the one or more the physical inputs to the mattress of the smart bed. Without limitation, a physical input may be provided as one or more taps, pats, or slaps on the surface of the mattress. The physical input may be provided at or in proximity to a particular location on the mattress (e.g., a central portion along a length of a side surface of the mattress; on the sleep surface near a head end, a central portion along a length of the mattress, and/or near a foot end; etc.).

Physical inputs may be distinguished from each other by type or intensity (e.g., a tap, a pat, a slap, etc.), number of distinct physical inputs (e.g., one, two, three, etc.), pattern (e.g., the amount of time that passes between physical inputs in a sequence of physical inputs, etc.), or the like, or any combination of the foregoing. The physical input may be detected by a sensor (e.g., an accelerometer, etc.) and the processor of the mattress. Upon detecting a physical input, the processor of the mattress may identify the physical input and a function that corresponds to the physical input. The processor may then execute the appropriate function, which may include adjusting at least one feature of the mattress, the smart bed of which the mattress is a part, and/or an environment in which the smart bed is located.

The functions that may be executed by the processor may include individual functions or combinations of functions (e.g., a sleep sequence, a nighttime out-of-bed sequence, a wake-up sequence, etc.). Some nonlimiting examples of functions that may be executed are heating and/or cooling the sleep surface of the mattress, ventilating at least a portion of the sleep surface, adjusting a softness/firmness of the mattress, an anti-snore feature of the smart bed (e.g., of its foundation, its mattress, etc.) (e.g., on the other side of the smart bed, etc.), adjusting an orientation of at least a portion of the mattress, and turning on and/or off lighting features. Other functions of a smart bed may also be executed in response to a physical input.

In addition to executing one or more functions of the smart bed in response to a physical input, at least one function may be initiated in an environment in which the smart bed is located. Such a function may include adjusting lighting within the environment (e.g., dimming or shutting off room lighting, turning a reading light and/or nightlight on, etc.), closing window blinds or shutters, adjusting a temperature within the environment, playing or otherwise controlling audio (e.g., music, audiobooks, sounds conducive to rest and/or sleep, subliminal sessions to be played during sleep, white noise, etc.), initiating or otherwise controlling an alarm system of a building or unit in which the smart bed is located, determining and adjusting, as necessary, the status of any of various systems and/or devices (heating/air conditioning, lighting, media, appliances, garage doors, etc.) of the building or unit where the smart bed is located, and the like.

Other aspects of the disclosed subject matter, as well as features and advantages of various aspects of the disclosed subject matter, should be apparent to those of ordinary skill in the art through consideration of the ensuing description, the accompanying drawings, and the appended claims.

DETAILED DESCRIPTION

Figure 1:
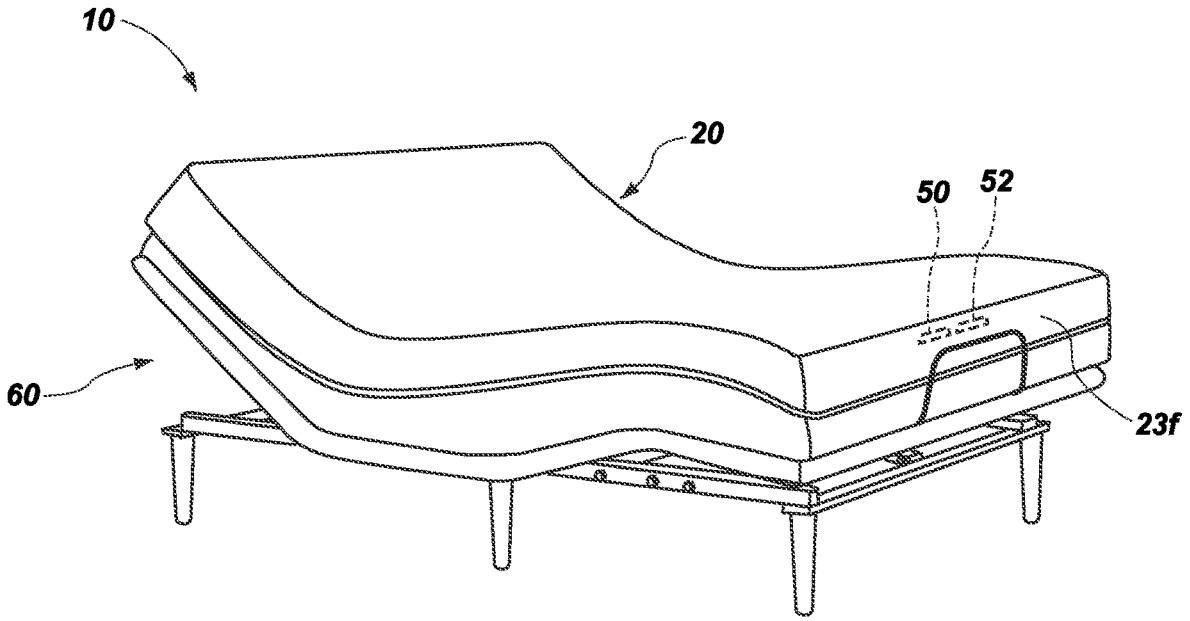
FIG. 1 provides a representation of an embodiment of a smart bed according to this disclosure and an environment (e.g., a bedroom, etc.) in which the smart bed is located.
Figure 2:
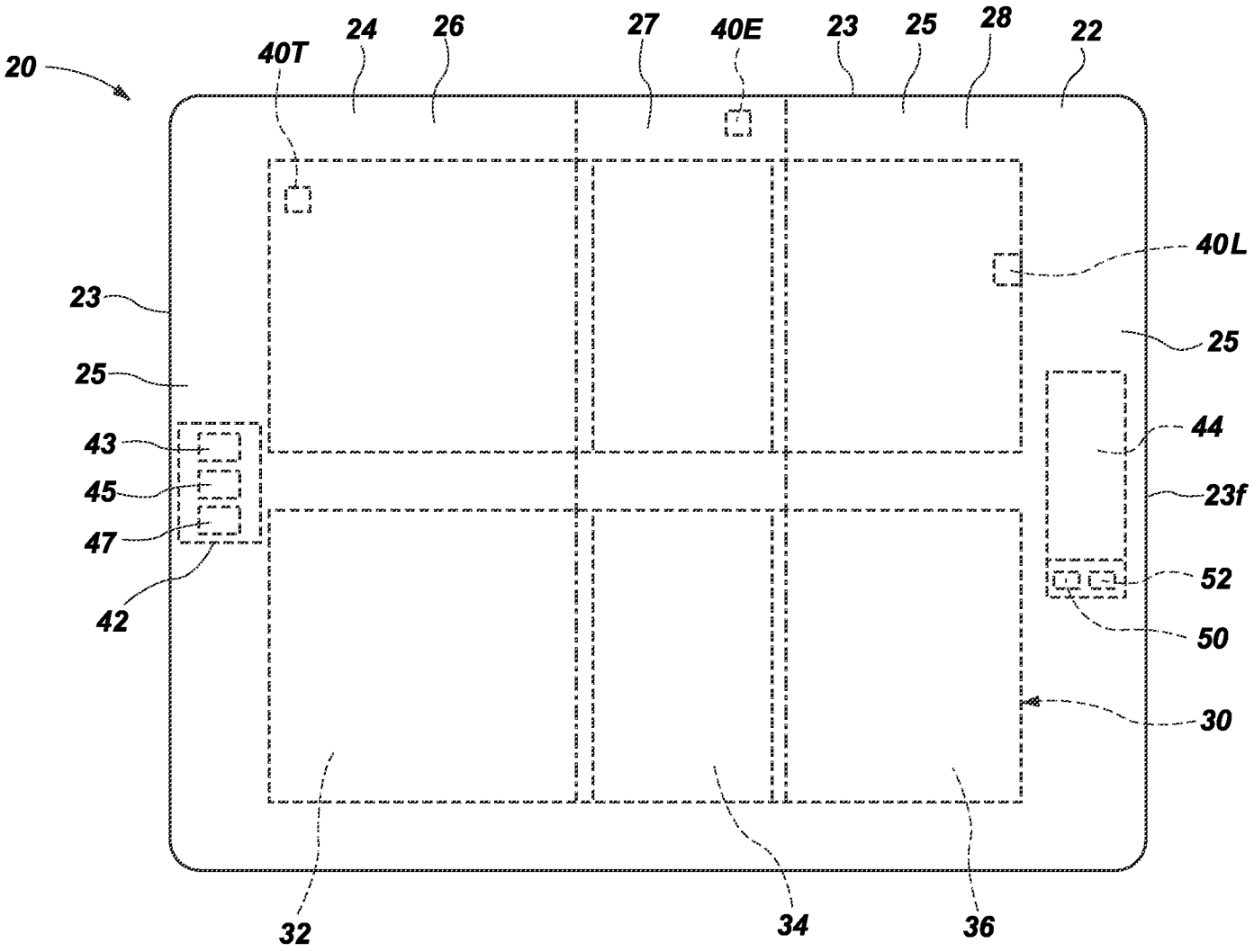
FIG. 2 provides a top view of the embodiment of the smart bed shown in FIG. 1.
Figure 3:
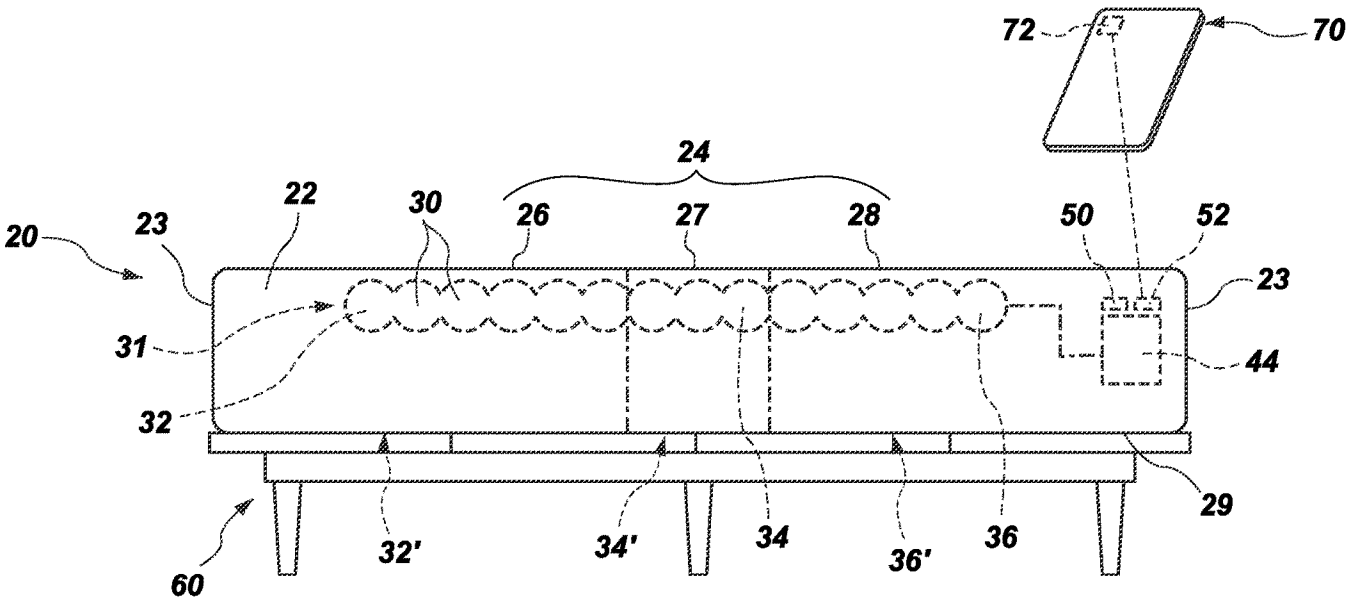
FIG. 3 is a side view of the embodiment of the smart bed shown in FIG. 1.

FIGS. 1-3 illustrate an embodiment of a smart bed 10. The smart bed 10 includes a mattress 20, at least one sensor 40 (including, without limitation, one or more thoracic sensors 40T, one or more leg sensors 40L, and/or one or more ambient environment sensors 40E, etc.), a processor 50, and at least one transceiver 52 with an associated antenna (not shown). In addition, the smart bed 10 may include a foundation 60.

The mattress 20 of the smart bed 10 may have any suitable shape and dimensions and may include a cover 22 that contains various internal elements (not shown) of the mattress 20. The mattress may include edges 23, a top surface, or sleep surface 24, between top ends of the edges 23, and a bottom surface, or base 29, between bottom edges of the edges 23. The sleep surface 24 of the mattress 20 may be configured to be slept on by at least one individual. The sleep surface 24 may include edge portions 25 at locations adjacent to side edges 23 of the mattress 20, a head portion 26, an intermediate portion 27, and a foot portion 28.

The mattress 20 may comprise any suitable type of mattress, such as a conventional mattress with springs and foam, a foam mattress, a memory foam mattress, a mattress with pressurizable bladders (e.g., air chambers, etc.), a mattress that includes a gel grid (e.g., those available from Purple Innovation, LLC, of Lehi, Utah and disclosed by U.S. Pat. Nos. 7,060,213, 7,076,822, and 8,919,750, which may be formed from any suitable material, including, but not limited to, an extended A-B-A triblock copolymer, such as those disclosed by U.S. Pat. Nos. 6,413,458, 6,797,765 and 7,964,664; the entire disclosures of each of the foregoing patents are hereby incorporated herein), or a mattress that includes any combination of these and/or other features.

The one or more sensors 40 may be carried by the mattress 20. Without limitation, at least one sensor 40 may be positioned adjacent to the sleep surface 24 of the mattress 20. For example, a sensor 40 may be positioned within a cover 22 of the mattress 20 in a manner that enables the sensor 40 to detect activity occurring on a sleep surface 24 of the mattress 20. More specifically, each sensor 40 may be positioned within a recess or a receptacle that opens to and communicates with an outer surface of a component of the mattress 20 that carries the sensor 40, with the cover 22 being placed over the recess or receptacle. In other embodiments, the sensor 40 may be incorporated into the cover 22 or positioned between the cover 22 and internal components (not shown) (e.g., a top layer of foam, gel, etc.) of the mattress 20.

In some embodiments, the mattress 20 may carry a plurality of sensors 40. Without limitation, at least one thoracic sensor 40T may be positioned at the head portion 26 and/or the intermediate portion 27 of the mattress 20. At least one leg sensor 40L may be positioned at the foot portion 28 of the mattress 20. At least one ambient environment sensor 40E may be positioned at an edge 23 (e.g., on, adjacent to, or within a side rail, etc.) of the mattress 20. In a specific embodiment, the mattress 20 may comprise a gel grid, with each thoracic sensor 40T and leg sensor 40L being positioned within a hollow column of the gel grid, adjacent to an upper surface of the gel grid, and each ambient environment sensor 40E being positioned within a recess or cavity that opens to or otherwise communicates with an outer surface of a side rail of the mattress 20.

The at least one thoracic sensor 40T may facilitate detection of the presence (or absence) of an individual on the sleep surface 24 of the mattress 20. In addition, the at least one thoracic sensor 40T may be used to monitor one or more of the individual's movement (e.g., motion, position on the sleep surface 24, etc.), respiration, and heart rate. The at least one thoracic sensor 40T may also monitor the temperature of the individual's body and, optionally, humidity. In a specific embodiment, the at least one thoracic sensor 40T may include an inclinometer (e.g., an inclinometer available from STMicroelectronics of Plan-les-Ouates, Switzerland, etc.), an accelerometer (e.g., an accelerometer available from MEMSIC Inc. of Andover, Massachusetts, etc.), and a plurality of temperature/humidity sensors (e.g., a temperature and/or humidity sensor available from Sensiron AG of Stäfa, Switzerland, etc.).

The at least one leg sensor 40L may facilitate the detection of the presence (or absence) of an individual on the sleep surface 24 of the mattress 20. In addition, the at least one leg sensor 40L may be used to monitor the individual's movement (e.g., motion, position, etc.), respiration, and heart rate. The at least one leg sensor 40L may monitor the temperature of the individual's legs and, optionally, humidity. In a specific embodiment, the at least one leg sensor 40L may include an accelerometer (e.g., an accelerometer available from MEMSIC Inc. of Andover, Massachusetts, etc.) and a plurality of temperature/humidity sensors (e.g., a temperature and/or humidity sensor available from Sensiron AG of Stäfa, Switzerland, etc.).

The at least one ambient environment sensor 40E may facilitate the detection of the presence (or absence) of an individual in proximity to a side edge 23 of the mattress 20 or on the sleep surface 24 of the mattress 20. In addition, the at least one ambient environment sensor 40E may be used to monitor information about an environment (e.g., a room, etc.) within which the mattress 20 is located, such as its temperature and/or humidity. In a specific embodiment, the at least one ambient environment sensor 40E may include an accelerometer (e.g., an accelerometer available from MEMSIC Inc. of Andover, Massachusetts, etc.) and a temperature/humidity sensor (e.g., a temperature and/or humidity sensor available from Sensiron AG of Stäfa, Switzerland, etc.).

In the illustrated embodiment of mattress 20, each thoracic sensor 40T and leg sensor 40L is shown at a location where an individual is expected to lie on the sleep surface 24 of the mattress 20 as he or she sleeps, with the mattress 20 having a size that accommodates two individuals. In other embodiments, including small mattresses (e.g., twin size, twin XL (extra-long) size, full size, etc.) and large mattresses (e.g., queen size, king sizes, etc.), thoracic sensors 40T and leg sensors 40L may be positioned along a midline of the mattress—alone or in combination with other sensor placements.

The processor 50 may comprise one or more processing elements of a suitable type (e.g., microprocessors, microcontrollers, digital signal processors (DSPs), etc.). In some embodiments, the processor 50 may comprise one or more microcontrollers, which may execute embedded programming (e.g., firmware) to control one or more dedicated functions. The processor 50 may be carried by the mattress 20 of the smart bed 10 (e.g., internally, adjacent to a foot 23*f* of the mattress 20; etc.), the foundation 60 of the smart bed 10, or elsewhere.

Activity detected by the sensors 40 may be communicated to the processor 50. The processor 50 may execute a program to determine whether the data from the sensors 40 indicates that an individual has provided a physical input on the mattress 20. If the processor 50 determines that an individual has provided a physical input, then the processor 50 may execute one or more programs that affect a state of the mattress 20, the smart bed 10 of which the mattress 20 is a part, and/or the environment in which the smart bed 10 is located. Execution of the one or more programs by the processor 50 may be referred to as execution of a function or sequence of functions by the processor 50.

The transceiver 52 may be associated with the processor 50 in a manner that enables the processor 50 to communicate with a processor 72 of a portable electronic device 70 (e.g., a smart phone, a tablet computer, a smart watch, etc.) or another device. Without limitation, the transceiver 52 may comprise one or more of a WiFi transceiver, a Bluetooth® transceiver, a near-field communication (NFC) (e.g., radiofrequency (RF), etc.) transceiver, a 2.4 GHz RF transceiver, or the like, along with its associated antenna. The transceiver 52 may be carried by the mattress 20 of the smart bed 10, by the foundation 60 of the smart bed 10, or elsewhere. In some embodiments, the transceiver 52 may be associated with (e.g., located adjacent to, packaged with, etc.) the processor 50 of the smart bed 10.

The processor 72 of the portable electronic device 70 may execute a smart bed control app, which may enable an individual to use the portable electronic device 70 to control operation of the smart bed 10 and/or devices in the environment E in which the smart bed 10 is located.

Figure 4:
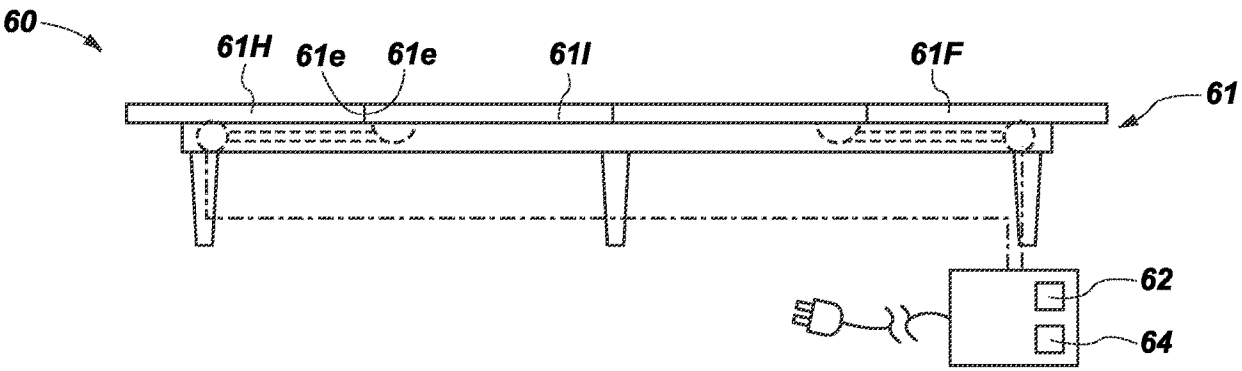
FIG. 4 is a side view of an embodiment of an adjustable foundation that may comprise part of the embodiment of the smart bed shown in FIG. 1.

As depicted by FIG. 4, the foundation 60 of the smart bed 10 may include any suitable foundation for the mattress 20. In some embodiments, the foundation 60 may comprise an adjustable platform (e.g., the Purple® Ascent Base™ adjustable platform, available from Purple Innovation, LLC, of Lehi, Utah, etc.). Such a foundation 60 may include a processor 62 (e.g., a microcontroller, a microprocessor, etc.), which may control movement of one or more adjustable sections 61H, 61I, 61F of a platform 61 that carries the mattress 20. In addition, such a foundation 60 may include a transceiver 64 (e.g., a WiFi transceiver, a Bluetooth® transceiver, a near-field communication (NFC) (e.g., RF, etc.) transceiver, a 2.4 GHz RF transceiver, etc.), along with an associated antenna (not shown). The transceiver 64 may receive signals from the processor 50 of the mattress 20 and/or a processor 72 of a portable electronic device 70 that may cause the processor 62 of the foundation 60 to move one or more sections 61A, 61I, 61F of the platform 61 of the foundation 60 in a desired manner (e.g., to move the mattress 20 or a portion thereof to a desired orientation, to operate an anti-snore feature of the foundation 60, etc.). In other embodiments, the foundation 60 may comprise a stationary foundation (e.g., a platform style bed frame, a conventional bed frame and box spring, etc.).

Figure 5:
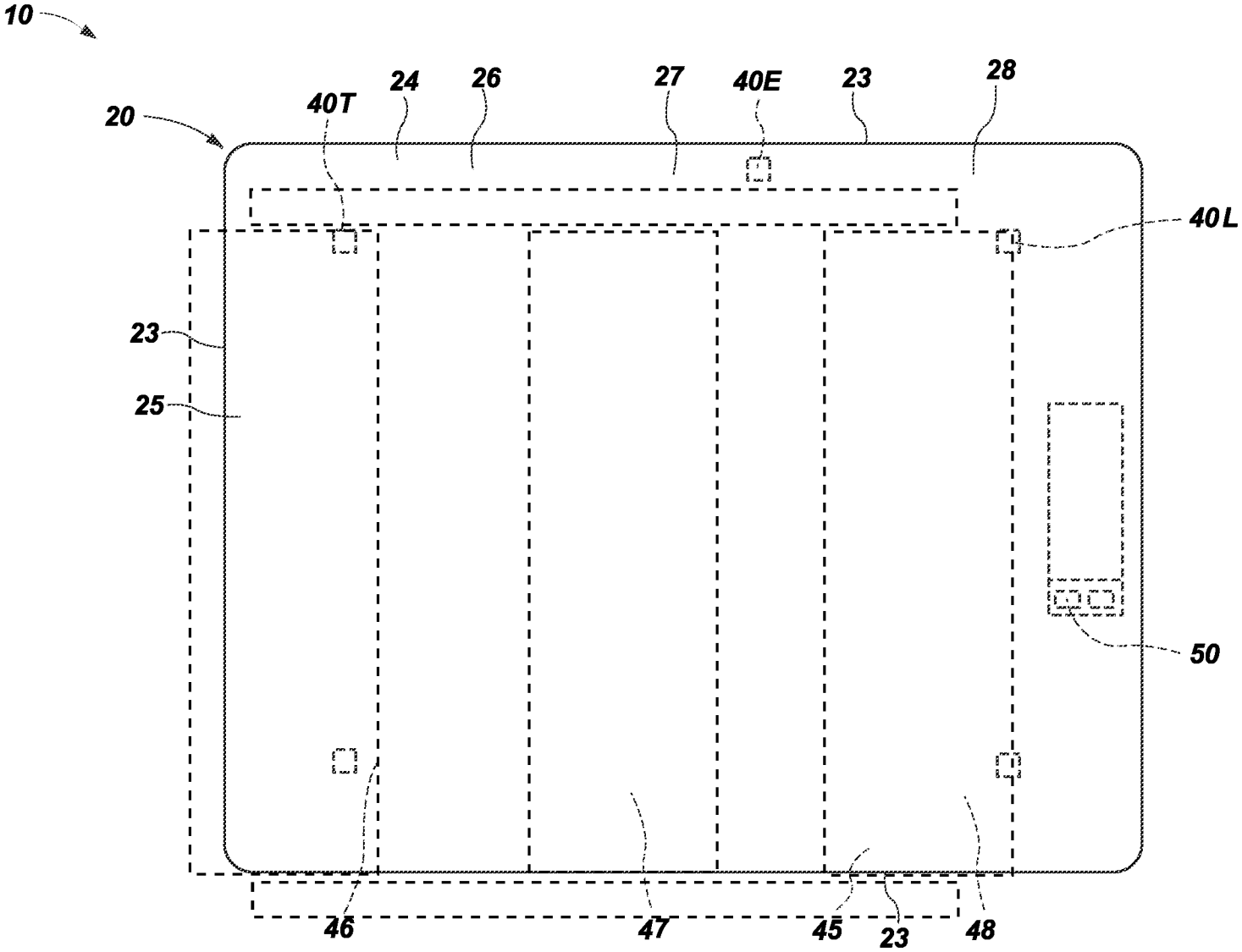
FIG. 5 provides a top view of the embodiment of the smart bed shown in FIG. 1, illustrating different locations at which in individual may provide physical inputs to the mattress of the smart bed.

With reference to FIG. 5, various locations where an individual may provide one or more physical inputs to the mattress 20 of the smart bed 10 (FIG. 1) are shown. One input location 45 is a central portion along a length of a surface of an edge 23 of the mattress 20 (e.g., over a side rail of the mattress 20). Another input location 46 is within a head portion 26 of the sleep surface 24 of the mattress 20, at or near a location where an individual would be expected to place their head while lying on the sleep surface 24. Another input location 47 is within the intermediate portion 27 of the sleep surface 24, at or near a location where an individual would be expected to place a hand next to their body while lying on the sleep surface 24. Yet another input location 48 is within a foot portion 28 of the sleep surface 24, at or near a location where an individual would be expected to place a foot while lying on the sleep surface 24.

One or more sensors 40 of the mattress 20 may detect a physical input provided on the mattress 20. For example, an ambient environment sensor 40E at the edge 23 of the mattress 20 may detect a physical input at input location 45. A thoracic sensor 40T of an edge portion 25 of the sleep surface 24 may detect a physical input at input location 46. A thoracic sensor 40T and/or a leg sensor 40L may detect a physical input at input location 47. A leg sensor 40L may detect a physical input at input location 48.

One or more physical inputs may be predefined. Thus, the processor 50 of the mattress 20 of the smart bed 10 may be preprogrammed to detect, determine a function corresponding to (i.e., recognize), and execute the appropriate function for one or more physical inputs. In some embodiments, including but not limited to those embodiments where one or more physical inputs are predefined, one or more physical inputs may be user-defined. Thus, each user-defined physical input may be programmed into the processor 50. In such embodiments, the user may define a particular physical input, a function that corresponds to a particular physical input, or the particular physical input and its corresponding function.

The processor 50 may "learn" an identity of an individual providing a physical input. Such learning may be similar to the manner in which machine learning occurs with respect to other types of biometric data. For example, the processor 50 may execute a program, or an app, that has an individual repeat one or more predetermined physical inputs, processes data from the physical input(s) (e.g., associates the data with the individual, etc.), and stores the process data for later comparison with subsequently entered physical inputs. Any suitable data from one or more physical inputs may be associated with an individual, including, without limitation, a location on the mattress 20 where the physical input is provided, an intensity of one or more physical inputs (e.g., a tap, a pat, a slap, a kick, etc.), an amount of time that passes between physical inputs in a sequence, and the like.

In embodiments where the processor 50 "learns" the identity of an individual who has provided a physical input, the processor 50 may also be programmed to "learn" individual preferences for one or more functions or one or more sets of functions. Thus, the processor 50 may associate a physical input made by a particular individual with a function or set of functions that corresponds to the physical input, with the function or set of functions being tailored to the particular individual. As a few examples, based on the physical input received, the processor 50 may be programmed to provide an amount of sleep surface 24 ventilation, a sleep surface 24 temperature, a sleep surface 24 orientation, a softness/firmness, or the like, tailored to the particular individual.

Figure 6:
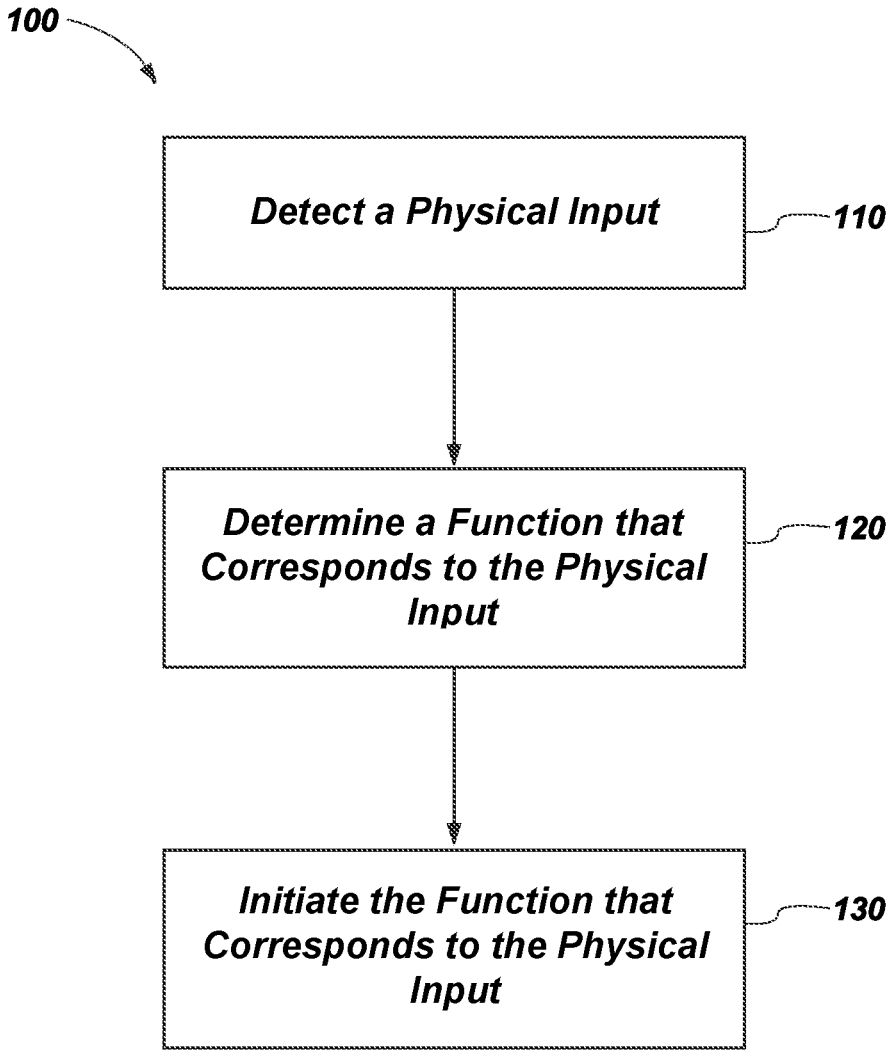
FIG. 6 is a flow diagram illustrating various acts that may occur in an embodiment of a method for providing a physical input on a mattress of a smart bed.

FIG. 6 is a diagram illustrating the flow of an embodiment of a method 100 of providing, detecting, and responding to a physical input on a surface of a mattress 20 of a smart bed 10, such as that depicted by FIGS. 1-3. The method 100 may include detecting a physical input, at reference 110, determining a function that corresponds to the physical input, at reference 120, and initiating the function, at reference 130.

With added reference to FIG. 5, in some embodiments, an individual may provide one or more physical inputs, at reference 110, on an edge 23 or the sleep surface 24 of the mattress 20. The physical inputs may be provided as taps, pats, or slaps on an input location 45, 46, 47, 48 of the mattress 20. Physical inputs may be distinguished from each other by type or intensity (e.g., a tap, a pat, a slap, a stomp, a kick, etc.), number of physical inputs in a sequence of physical inputs (e.g., one, two, three, etc.), pattern (e.g., the amount of time that passes between physical inputs in a sequence of physical inputs, etc.), or the like, or any combination of the foregoing.

The function that corresponds to a physical input may be determined, at reference 120 of FIG. 6, by the processor 50 (see, e.g., FIG. 1). Optionally, the processor 50 may determine the identity of the individual who provided the physical input. In embodiments where the processor 50 determines the identity of the individual who provided the physical input, such a determination may be made based on the location and/or manner in which the physical input was provided or in another manner (e.g., by recognizing the individual on the sleep surface, as disclosed by U.S. patent application Ser. No. 17/978,186, titled INDIVIDUAL IDENTIFICATION AND CUSTOMIZED ADJUSTMENT BY A SMART BED, the entire disclosure of which is hereby incorporated herein; etc.). The processor 50 (see, e.g., FIG. 1) may then, at reference 130 of FIG. 6, execute the function or set of functions corresponding to each physical input.

More specifically, the processor 50 may execute each appropriate function by adjusting a feature of the mattress 20, a feature of the smart bed 10 (FIG. 1) of which the mattress 20 is a part, or the environment E (FIG. 1) in which the smart bed 10 is located. In embodiments where the processor 50 recognizes the individual providing the physical input from the physical input itself or in another manner, each adjustment to the mattress 20, the smart bed 10, and/or the environment E may be made in a manner tailored to the individual.

With returned reference to FIG. 1, some non-limiting examples of functions that may be executed by the processor 50 upon receiving and detecting a particular physical input include: heating and/or cooling the sleep surface 24 to a pre-set temperature; ventilating at least a portion of the sleep surface 24 (see, e.g., U.S. Pat. No. 11,311,111, the entire disclosure of which is hereby incorporated herein); providing the mattress 20 with a pre-set firmness (see, e.g., U.S. Pat. No. 11,213,139, the entire disclosure of which is hereby incorporated herein); turning on an anti-snore feature of the smart bed 10 (e.g., of its foundation 60, its mattress 20, etc.); adjusting an orientation of at least a portion of the mattress 20 (e.g., with the platform 60, etc.); and turning on and/or off lighting features of the smart bed 10. Other functions of the smart bed 10 may also be initiated.

Figure 7:
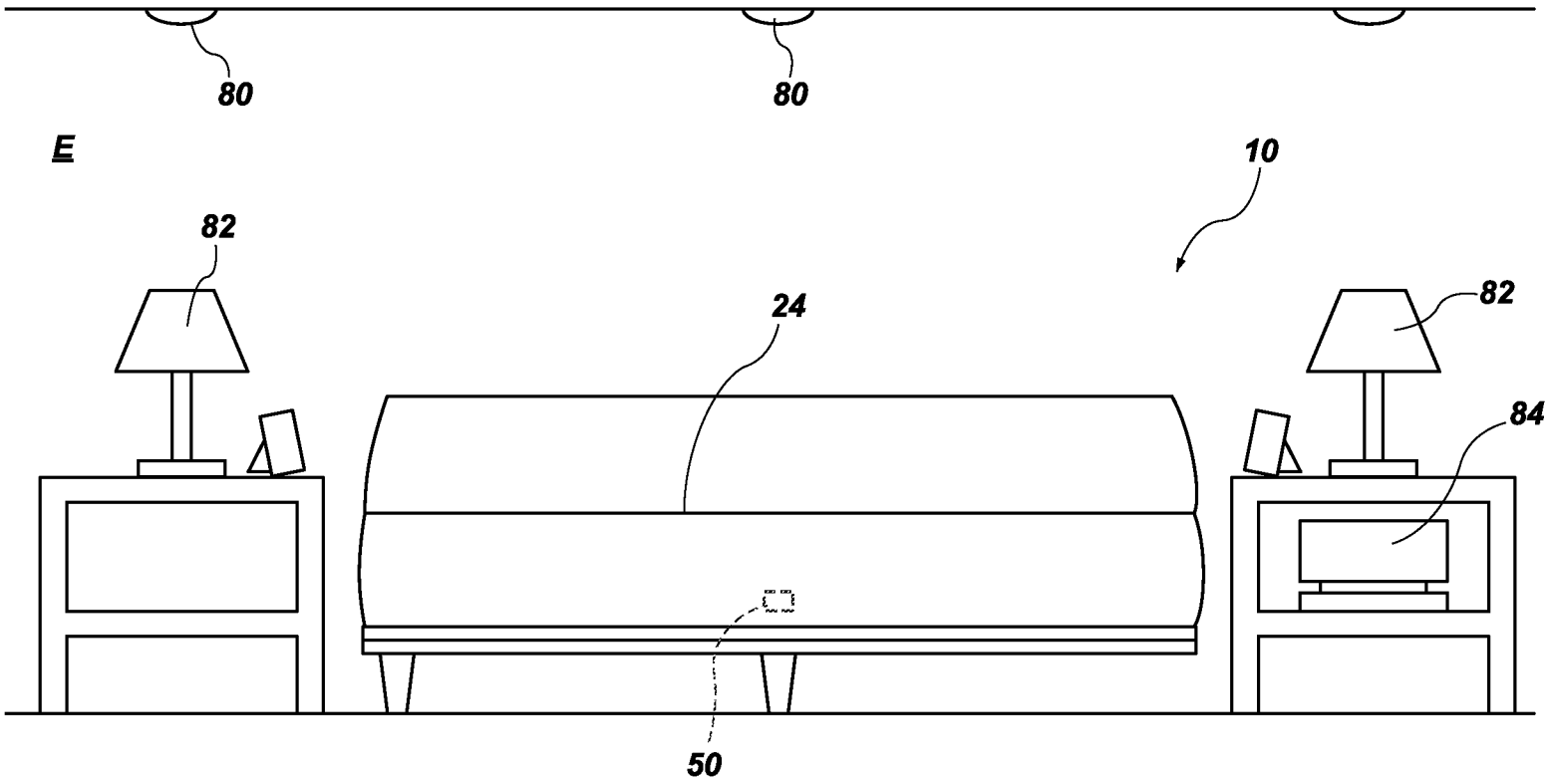
FIG. 7 depicts an embodiment of an environment in which a smart bed may be located.

In addition to initiating one or more functions of the smart bed 10, with reference to FIG. 7, the processor 50 may execute at least one function in an environment E in which the smart bed 10 is located. Such a function may include adjusting lighting within the environment E (e.g., dimming or shutting off room lighting 80, turning a reading light 82 and/or nightlight on, etc.), closing window blinds or shutters, adjusting a temperature within the environment E, playing or otherwise controlling audio 84 (e.g., music, audiobooks, sounds conducive to rest and/or sleep, subliminal sessions to be played during sleep, white noise, etc.), initiating or otherwise controlling an alarm system of a building or unit in which the smart bed 10 is located, determining and adjusting, as necessary, the status of any of various systems and/or devices (heating/air conditioning, lighting, media, appliances, garage doors, etc.) of the building or unit where the smart bed 10 is located, and the like.

In some embodiments, the processor 50 may execute a set of functions. The set of functions may correspond to: a set of functions associated with an individual's efforts to go to sleep, as disclosed by U.S. patent Application Ser. No. 17/978,119, titled SLEEP SEQUENCE INITIATION FOR A SMART BED ("the '119 application"), the entire disclosure of which is hereby incorporated herein; a set of nighttime out-of-bed functions, as disclosed by U.S. patent Application Ser. No. 17/978,167, titled SEQUENCE INITIATION FOR PLACING A SMART BED IN AN OUT-OF-BED STATE ("the '167 application"), the entire disclosure of which is hereby incorporated herein; a wake-up set of functions, as disclosed by the '167 application, or any other set of functions.

A simple physical input (e.g., a single tap, pat, slap, etc.; two taps, pats, slaps, etc.; etc.) may correspond to a function that would typically occur in response to an unintended interruption in an individual's sleep. For example, an individual may provide a simple physical input if they have been awakened by a partner's snoring, in which case a physical input on one side of the mattress 20 may initiate one or more anti-snore functions on the other side of the mattress 20. As another example, an individual may provide a simple physical input when their sleep is interrupted by an environmental factor (e.g., a light, audio, etc.), in which case a physical input may shut off activity in the environment E (e.g., turn off a light 80, 82, turn off audio 84, etc.) in which the smart bed is located. In yet another example, an individual may provide a simple physical input to initiate and/or terminate a nighttime out-of-bed set of functions (e.g., low ambient lighting, heating a sleep surface 24 of the mattress 20, etc.) that will enable them to conduct activity out of bed and return to bed without a significant disturbance in their restful state or a partner's sleep.

A more complex physical input (e.g., a more complex sequence of taps, pats, and/or slaps, etc.) may correspond to functions that may be initiated while an individual is awake. As an example, an individual may provide a complex physical input to prepare the mattress 20, the smart bed 10, and/or the environment E in which the smart bed 10 is located for sleep, or to adjust ventilation, a temperature, an orientation, and/or a softness/firmness of the sleep surface 24 of the mattress 20.

Although this disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A smart bed, comprising:

a mattress including a gel grid, the mattress having an outer top surface defining a sleep surface and side edges;

at least one sensor positioned within a hollow column of the gel grid adjacent to the sleep surface and/or a side edge of the mattress, the hollow column opening toward the outer top surface of the mattress, the at least one sensor capable of sensing a physical input on the sleep surface or the side edge of the mattress;

a cover positioned over the outer top surface of the mattress; and a processor in communication with the at least one sensor and programmed to:

detect the physical input on the sleep surface or the side edge of the mattress;

determine at least one function of the smart bed that corresponds to the physical input; and execute the at least one function of the smart bed or at least one function of an environment in which the smart bed is located.

2. The smart bed of claim 1, wherein the processor is further programmed to:

identify an individual who provided the physical input.

3. The smart bed of claim 2, wherein the processor is programmed to identify the individual who provided the physical input through a location at which the physical input is provided and/or a manner in which the physical input is provided.

4. The smart bed of claim 2, wherein the processor is further programmed to:

execute the at least one function of the smart bed in a manner that corresponds to an identity of the individual present on the sleep surface.

5. The smart bed of claim 1, wherein the mattress includes at least one of:

a temperature control system;

a ventilation system; and a firmness adjustment system.

6. The smart bed of claim 5, wherein the at least one function of the smart bed comprises adjusting the temperature control system, the ventilation system, or the firmness adjustment system.

7. The smart bed of claim 1, further comprising:

an adjustable platform.

8. The smart bed of claim 7, wherein the at least one function of the smart bed comprises adjusting the adjustable platform.

9. The smart bed of claim 1, wherein the at least one function of the environment in which the smart bed is located comprises adjusting lighting, adjusting a room temperature, controlling audio, or controlling an alarm system.

10. The smart bed of claim 1, wherein the physical input comprises at least one tap, pat, or slap.

11. The smart bed of claim 1, wherein the physical input comprises a sequence of taps, pats, or slaps.

12. A method of using a smart bed, comprising:

detecting a physical input on a mattress having a gel grid via at least one sensor positioned within a hollow column of the gel grid adjacent to a sleep surface and/or a side edge of the mattress, the hollow column opening toward an outer top surface of the mattress and covered via a cover positioned over the outer top surface of the mattress;

identifying at least one function corresponding to the physical input, the at least one function comprising at least one function of the smart bed or at least one function of an environment in which the smart bed is located; and executing the at least one function based on a location of an individual on the sleep surface.

13. The method of claim 12, wherein detecting the physical input comprises detecting a tap, a pat, a slap, a stomp, or a kick on the mattress.

14. The method of claim 12, further comprising:

identifying an individual who provided the physical input.

15. The method of claim 14, wherein identifying the individual who provided the physical input comprises identifying the individual based on a location at which the physical input is provided and/or a manner in which the physical input is provided.

16. The method of claim 14, wherein executing the at least one function comprises executing the at least one function of the smart bed in a manner that corresponds to an identity of the individual who provided the physical input.

17. The method of claim 12, wherein:

identifying the at least one function comprises identifying a set of functions corresponding to the physical input; and executing the at least one function comprises executing the set of functions.

18. The method of claim 17, wherein executing the set of functions comprises executing a set of functions corresponding to a sleep set of functions, a nighttime out-of-bed set of functions, or a wake-up set of functions.

19. The method of claim 12, wherein executing the function comprises executing an anti-snore function.

20. The method of claim 19, wherein the physical input is detected on a first side of the mattress and the anti-snore function is executed on a second side of the mattress, opposite from the first side.

* * * * *